United States Patent [19]

DiVito

[11] Patent Number: 4,838,291

[45] Date of Patent: Jun. 13, 1989

[54] AXILLIARY CRUTCH

[75] Inventor: Fred DiVito, Asharoken, N.Y.

[73] Assignee: Lumex, Inc., Bay Shore, N.Y.

[21] Appl. No.: 263,980

[22] Filed: Oct. 25, 1988

Related U.S. Application Data

[63] Continuation of Ser. No. 33,398, Apr. 1, 1987, abandoned.

[51] Int. Cl.[4] ..... A61H 3/02

[52] U.S. Cl. ..... 135/68; 135/72

[58] Field of Search ..... 135/65, 66, 67, 68, 135/69, 70, 71, 72; 272/70.2, 70.3, 70.4

[56] References Cited

U.S. PATENT DOCUMENTS

| | | | |
|---|---|---|---|
| 267,680 | 11/1882 | Crandall | 135/68 |
| 909,224 | 1/1909 | Rhodes | 135/72 |
| 1,035,760 | 8/1912 | Walton | 135/69 |
| 1,277,009 | 8/1918 | Weldon | 135/65 |
| 1,505,081 | 8/1924 | Arndt | 135/69 |
| 2,297,173 | 9/1942 | Shipman et al. | 272/70.4 |
| 2,547,265 | 4/1951 | Hilgeman | 135/73 |
| 2,554,653 | 5/1951 | Wisecarver | 135/68 |
| 2,614,332 | 10/1952 | Zadronzy | 135/69 |
| 3,633,906 | 1/1972 | Fowler | 272/70.3 |
| 3,730,198 | 5/1973 | Johnston et al. | 135/69 |
| 4,386,466 | 6/1983 | Lee | 135/68 |
| 4,509,741 | 4/1985 | Smith | 135/69 |

FOREIGN PATENT DOCUMENTS 675275 7/1952 United Kingdom .

*Primary Examiner*—Robert A. Hafer
*Assistant Examiner*—Charles H. Sam
*Attorney, Agent, or Firm*—Davis Hoxie Faithfull & Hapgood

[57] ABSTRACT

An improved axillary crutch is disclosed. The crutch has two inter-connected hollow-tube frame members. The bottom frame member is radially shaped at the end which comes in contact with the floor, the radial design of the bottom frame member being derived from the natural arching motion of the crutch. A radial crutch tip is fitted over the radial end of the bottom frame member. The bottom frame member telescopes into the top frame member. A bolt within the handle of the crutch passes through apertures in each frame member and is secured by a wing nut. The height of the crutch is changed by removing the bolt, telescoping the bottom frame member into or out of the top frame member and resecuring the bolt at the desired location. The handle can also be moved relative to the crutch by removing the bolt, changing the position of the handle, and securing the handle at the desired location by reinserting the bolt. Adjusting the crutch height and the handle height both can be accomplished in one step.

3 Claims, 4 Drawing Sheets

AXILLARY CRUTCH

This is a continuation of co-pending application Ser. No. 033,398 filed on Apr. 1, 1987, now abandoned.

FIELD OF THE INVENTION

This invention relates to an improved axillary crutch with improved balance, stability and weight-bearing capabilities to enable persons with lower limb disorders to ambulate more easily.

BACKGROUND OF THE INVENTION

For persons with lower limb disorders (broken leg bones, leg-muscle strains or pulls, knee injuries, broken foot bones, etc.) there continues to be a need for improved axillary crutch designs to make ambulation easier. There also continues to be a need for improved axillary crutch designs having increased balance, stability and weight-bearing capabilities.

Conventional axillary crutches, made in the so-called brace-bow configuration, have a single tubular member extending down from two substantially parallel tubular members, whereby a rubber crutch tip fitted over the bottom of the single tubular member comes into contact with the floor as the user ambulates. The two substantially parallel tubular members are bowed at their lower extremities and are there connected to the single tubular member. All of the weight of the user is transmitted to the single tubular member.

In such conventional crutches, the surface of the crutch tip on the single tubular member which comes into contact with the floor is flat. These crutches can become unstable as the user applies rotative pressure to the crutch while ambulating. Also, as stated above, all of the user's weight is applied on the single tubular member, resulting in a concentrated weight distribution over a limited surface area. Further, the crutch tip at the bottom of the crutch tends to become worn because pressure is applied unevenly on the tip as the crutch is used. Overwear of the crutch tip can cause safety problems during ambulation.

Further, adjusting the height of the crutch to better fit the height of the user and adjusting the height of the handle on the crutch to further accommodate the user involves two independent and time-consuming steps on conventional crutches.

There remains a need for an improved axillary crutch which allows for easier ambulation by persons with lower-limb disorders, and provides increased balance, stability and increased weight-bearing capabilities. There also remains a need for an easy-to-use crutch height and handle adjustment mechanism which allows for one-step adjustment of crutch height and handle height.

SUMMARY OF THE INVENTION

The improved axillary crutch of the present invention comprises two inter-connected hollow tubular frame members. A bottom frame member has a bottom arcuate end, the design of which is derived from the natural arcing motion of the crutch during ambulation.

A top end of the bottom frame member telescopes into a bottom end of a top frame member. A height and handle adjusting means interconnects and secures a handle, the top frame member and the bottom frame member. The handle in the height and handle adjusting means has a central bore through which a bolt extends.

On either side of the crutch the bolt also extends through aligned apertures in the top frame member and the bottom frame member. A wing nut screwed on a threaded portion of the bolt is used to secure the top frame member, the bottom frame member and the handle together.

To adjust the height of the crutch relative to the floor, a user or operator unscrews the wing nut, removes the bolt, telescopes the bottom frame member to the desired position within the top frame member and then reinserts the bolt into the properly aligned holes in the top frame member and the bottom frame member. The height of the handle relative to the crutch may also be adjusted in the same step by moving the handle relative to the top frame section and the bottom frame section after the bolt is removed.

DETAILED DESCRIPTION OF THE INVENTION

Reference is made in this description by numbers to the various components and sections of the axillary crutch of the present invention. Like numerals in this description and in the figures are understood to refer to like components and sections of the crutch. It is to be understood throughout this application that the term "axillary crutch" refers to a crutch which the user places under his or her axilla or armpit area.

Figure 1:
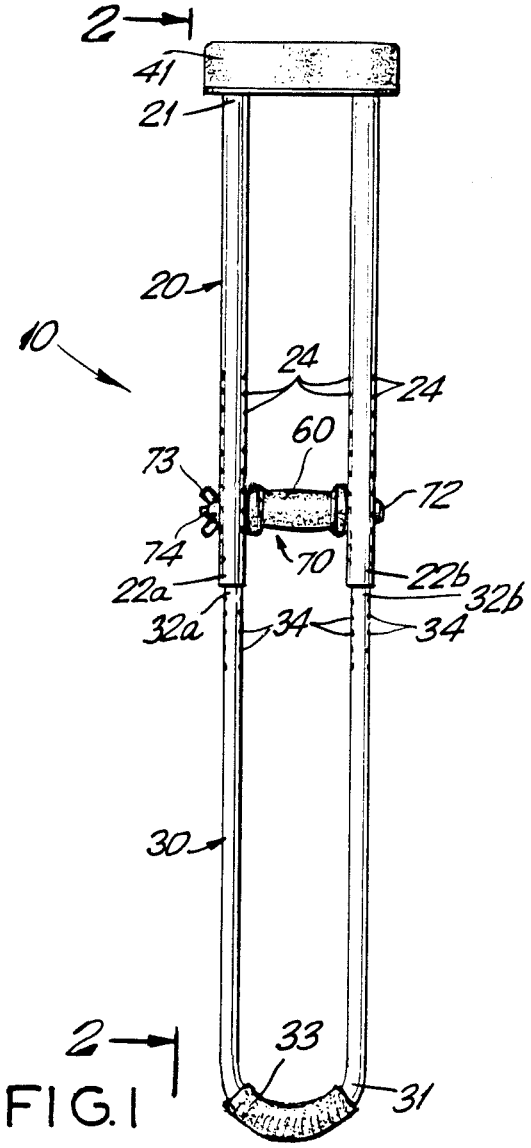
FIG. 1 is a front elevational view of an axillary crutch of the present invention.
Figure 7:
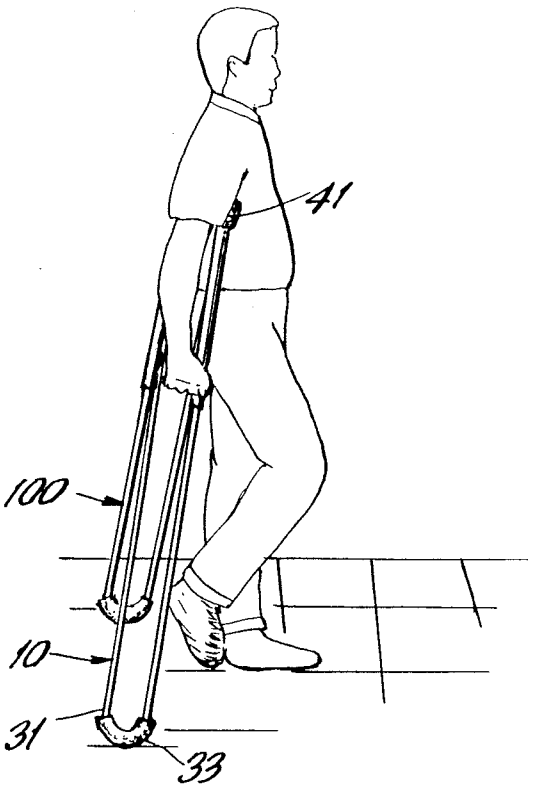
FIGS. 5–7 are perspective views showing the use of the axillary crutch of the present invention by a user with a lower-limb disorder.
Figure 6:
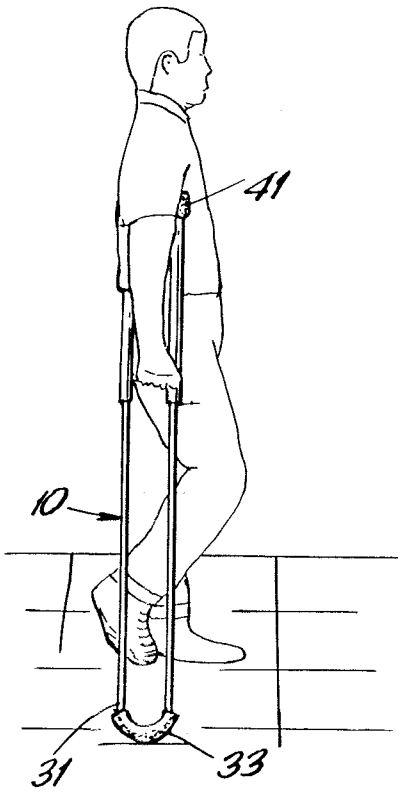
Figure 5:
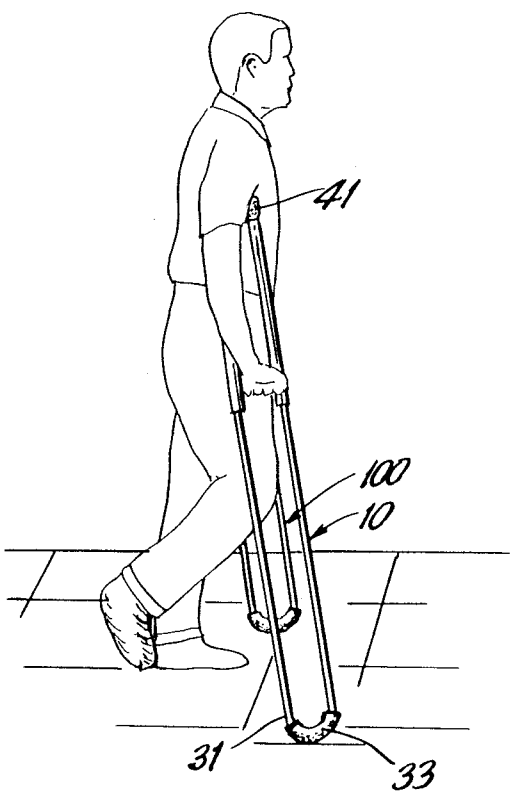

FIG. 1 shows in elevation an axillary crutch 10 of the present invention. As with most axillary crutches, the crutch of the present invention is best used in pairs, as shown in FIGS. 5–7. The second crutch 100 shown in FIGS. 5–7 is identical in construction to crutch 10 and it is understood that the description given below for crutch 10 applies equally to crutch 100. Of course, the crutch of the present invention may be used alone or in pairs, depending on the needs of the user.

Figure 3:
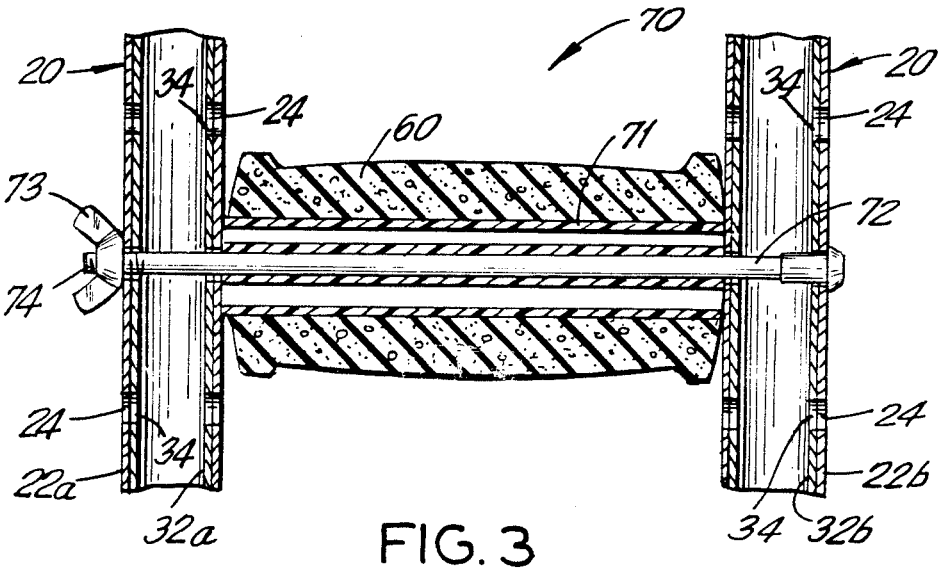
FIG. 3 is a detail view, partly in section, of a height and handle adjustment means of the crutch of FIG. 1.
Figure 4:
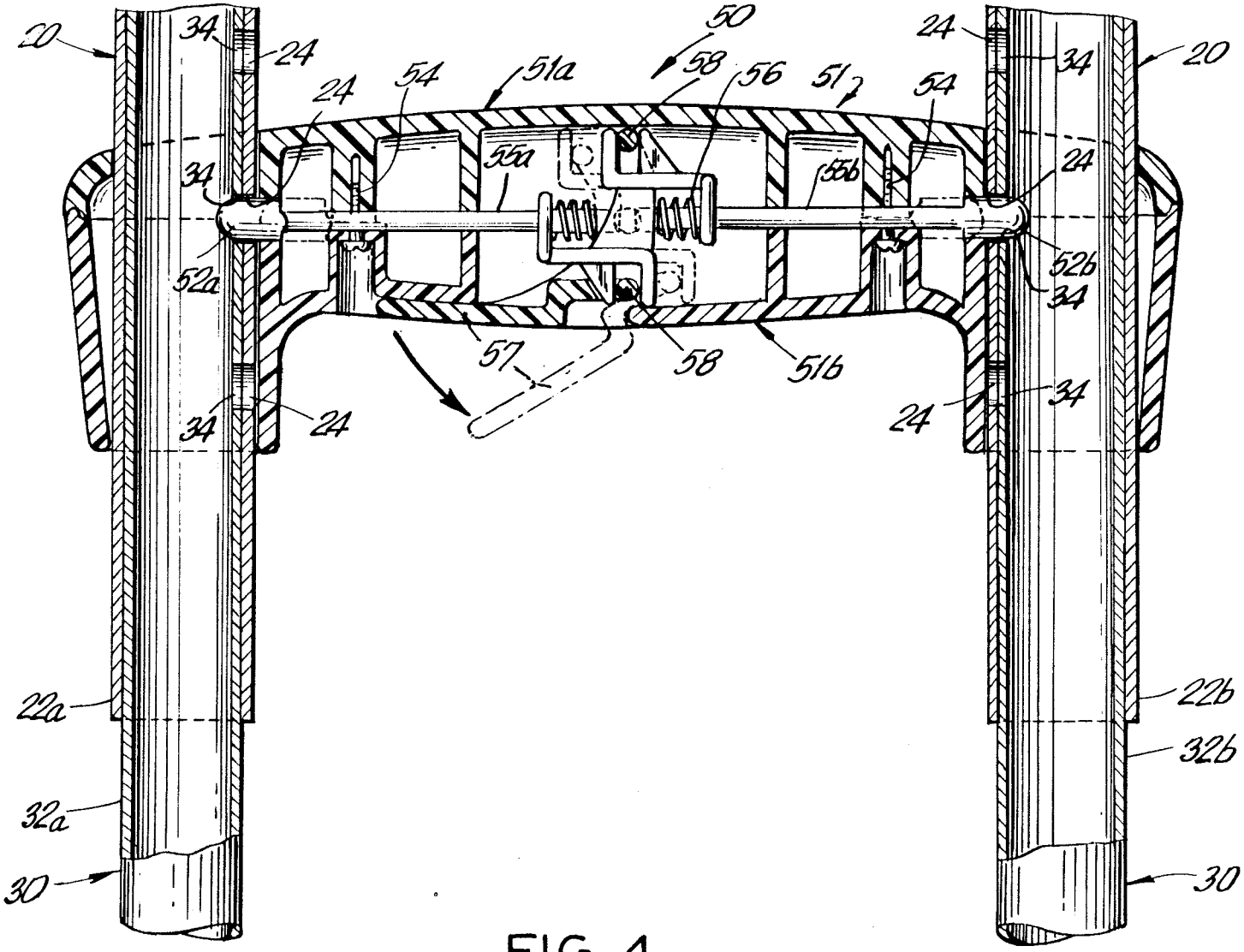
FIG. 4 is an alternate embodiment for the height and handle adjustment means of FIG. 3.

The crutch 10 has two basic frame pieces as shown in the figures—an underarm bend section 20 and an arcuate foot bend section 30. Sections 20 and 30 each comprise a single piece of hollow tubing and are of aluminum in the present embodiment. Height and handle adjustment means 70, shown in detail in FIGS. 3 and 1A, interconnects sections 20 and 30 and provides for one-step adjustment of the height of crutch 10 relative to the floor and adjustment of the height of a handgrip 60 relative to the crutch 10, as described below. An alternate embodiment 50 for the height and handle adjustment means is shown in FIG. 4.

Figure 1A:
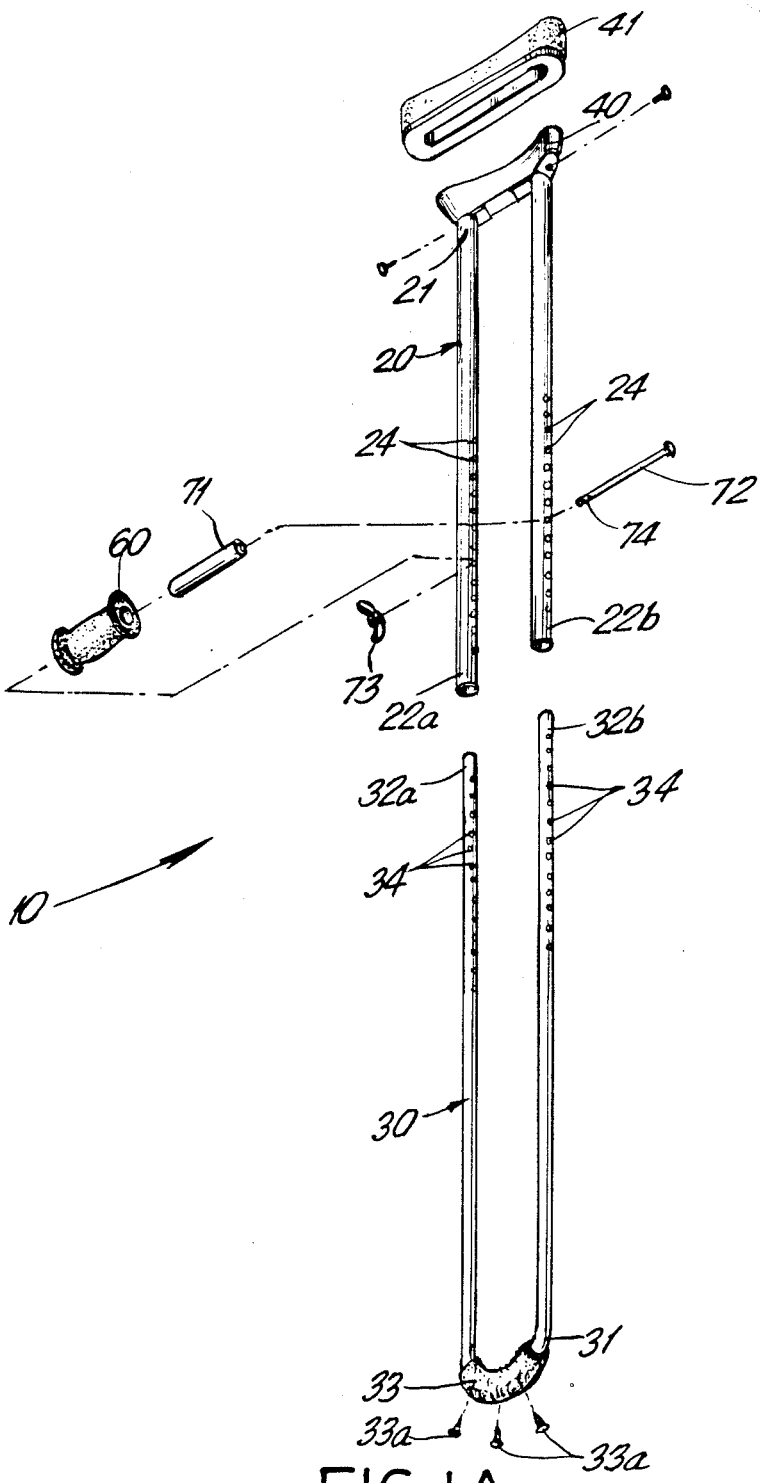
FIG. 1A is an exploded view of the crutch of FIG. 1.

Underarm bend section 20 has a top end 21, on which an underarm support 40 is secured as shown in FIG. 1A. An underarm pad 41 fits, as seen in FIG. 1A, over the support 40. In the present embodiment the pad 41 is made of a foam rubber material. As seen in FIGS. 5–7, to use the crutch 10, the user places the pad 41 underneath his or her axilla or armpit area.

A bottom end of section 20 terminates in two hollow tubular cross-section segments 22*a* and 22*b*, best seen in FIGS. 1 and 1A. Segments 22*a* and 22*b* are parallel to one another and terminate at the same vertical level, also as shown in FIGS. 1 and 1A. The segments 22*a* and 22*b* contain equally-spaced apertures 24 for use in securing the height and handle adjustment means 70 as described below.

Figure 2:
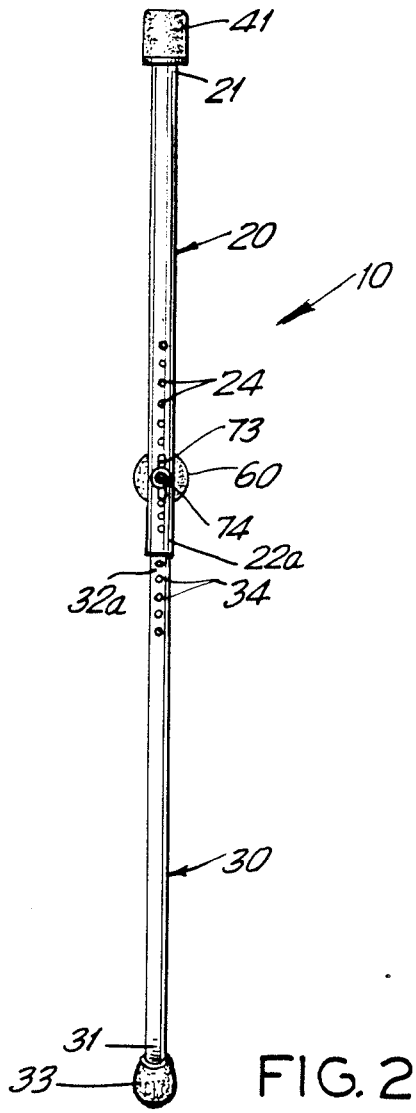
FIG. 2 is a side view of the crutch of FIG. 1 along lines 2—2 of FIG. 1.

A top end of arcuate foot bend section 30 has two hollow tubular cross-section segments 32*a* and 32*b*, best seen in FIG. 1A. Segments 32*a* and 32*b*, which are also parallel to one another and terminate at the same vertical level, in the present embodiment have less of a diameter than segments 22*a* and 22*b* and telescope into the segments 22*a* and 22*b* of the underarm bend section 20 as shown in FIGS. 1, 2 and 3. It is understood that crutch 10 could also be designed such that segments 32*a* and 32*b* have a diameter greater than segments 22*a* and 22*b* and thus segments 22*a* and 22*b* would telescope into segments 32*a* and 32*b*. As with segments 22*a* and 22*b* the segments 32*a* and 32*b* contain equally-spaced apertures 34 for use in securing the height and handle adjustment means 70 as described below.

A lower end 31 of the section 30 is arcuate in shape, as shown in FIGS. 1, 1A and 5–7. A crutch tip 33, also arcuate in shape, made in the present embodiment of Santoprene®, a thermoplastic rubber, is attached to the lower end 31 of the section 30. FIG. 1A shows the crutch tip 33 secured to the lower end 31 of the section 30 by screws 33*a*, but it is understood that any number of attachment means are suitable. Crutch tip 33 comes in contact with the floor surface as the user ambulates, as shown in FIGS. 5–7.

The arcuate design of the lower end 31 of the section 30 is derived from the natural arcing motion of the crutch 10 during ambulation, and thus makes ambulation easier. As seen in FIGS. 5–7, this arcuate design permits constant contact of a large part of the surface area of the tip 33 with the floor through the full range of ambulatory motion providing a more balanced, stable and increased weight-bearing ambulation than with conventional crutch designs. These advantages are derived in part because there is a greater surface area of the tip 33 which is in contact with the floor during ambulation compared to conventional crutch designs. Also, unlike with conventional crutch tips, the continuous nature of the contact between the arcuate crutch tip 33 and the floor prevents excessive wearing of any edge or portion of the tip 33, increasing the useful life of the tip 33.

The arcuate design of the section 30 also aids in distributing the user's weight more evenly during ambulation. Unlike conventional crutches, where all of the user's weight is distributed at one location, the arcuate design of the crutch of the present invention evenly distributes such weight, resulting in less strain on the various components and also allowing the user to ambulate more easily.

The details of the height and handle adjustment means 70 are shown in FIGS. 3 and 1A. The means 70 includes a plastic handle 71 which extends from one side of the crutch 10 to the other. A bolt 72 passes through a set of apertures 24 and 34 in sections 20 and 30, through a central opening in the handle 71, and then through a second set of apertures 24 and 34. The bolt is secured to the sections 20 and 30 by means of a wing nut 73 tightened on a threaded portion 74 of the bolt 72. Handgrip 60 has a central bore for receipt of the handle 71.

To change the height of the crutch 10 relative to the floor, the user or operator unscrews the wing nut 73 and then removes the bolt 72 from the handle 71. The segments 32*a* and 32*b* may then be telescoped further into or further out of segments 22*a* and 22*b* by the user or operator until the desired vertical height for the crutch 10 is reached.

The user or operator then aligns apertures 24 and 34 as required, inserts the bolt 72 through one set of aligned apertures 24 and 34, through the central bore in the handle 71 and then through another set of aligned apertures 24 and 34 on the other side of the crutch 10. To secure the height and handle adjustment means 70, the user or operator tightens the wing nut 73 on the threaded portion 74 of the bolt 72.

The height of the handgrip 60 relative to the crutch 10 may also be changed by unscrewing the wing nut 73 and removing the bolt 72 in the manner described above. The handgrip 60 and the handle 71 within it are then moved to a different set of aligned apertures 24 and 34 and the bolt is reinserted through the new apertures 24 and 34 and secured to the sections 20 and 30 by means of the wing nut 74 in the manner described above.

In the present embodiment the handgrip 60 is made of a foam rubber material. The handgrip 60 is designed to reduce hand fatigue by dispersing loads over a larger surface area than typical crutches during ambulation.

The height of the crutch 10 of the present invention can be adjusted to accommode users between the heights of 5'0" and 6'5". The telescoping of the arcuate foot bend section 30 into the underarm bend section 20 allows for this wide range of adjustment.

In conventional crutches, such as the brace-bow configuration described above, height adjustment of the crutch is much more limited because if the singular tubular member in such crutches is too long, the added torque developed can cause instability during ambulation. Further, the increased torque can cause unwanted structural stress on the crutch components, especially at the point where the single tubular member is connected to the bowed upper tubular members.

To avoid the problems described above, manufacturers of conventional axillary crutches usually provide two separate crutch models, one for shorter persons and one for taller persons. The crutch 10 of the present invention is designed to accommodate users of widely-varying height so that one model may be used by almost any person, regardless of height.

The details of the alternate embodiment 50 of the height and handle adjustment means are shown in FIG. 4. The means 50 includes a handle 51 with a top half section 51*a* and a bottom half section 51*b*. In this alternate embodiment each handle section 51*a* and 51*b* is made of acrylonitrile butadiene styrene (ABS). Sections 51*a* and 51*b* of the handle 51 are connected together by mechanical means, such as screws 54 shown in FIG. 4, though it is readily understood that other suitable fastening or connecting means may be used.

Retractable pins 52*a* and 52*b* are located at the outer ends of shafts 55*a* and 55*b*, respectively, within handle 51. Shafts 55*a* and 55*b* run through the center of the handle 51 as shown in FIG. 4. Spring 56, wound around shafts 55*a* and 55*b* as shown in FIG. 4, ensures that pins 52*a* and 52*b* are normally in the loaded position, i.e. will engage in the aligned apertures 24 and 34 of sections 20 and 30 to secure the handle 51 to the sections 20 and 30 at the desired location.

To change the height of the crutch 10 relative to the floor for this alternative embodiment, the user or operator rotates lever 57 on handle 51 in the direction of the arrow of FIG. 4 to the position shown by the dotted lines in FIG. 4, causing nylon cam 58 in handle 51 to release the spring loading on pins 52*a* and 52*b*, thus retracting pins 52*a* and 52*b* on shafts 55*a* and 55*b* from engagement in the apertures 24 and 34. The segments 32*a* and 32*b* may then be telescoped further into or further out of segments 22*a* and 22*b* by the user or operator until the desired vertical height for the crutch 10 is reached. The user or operator then rotates the lever 57 back to its secured position, in the direction opposite to the arrow in FIG. 4, causing the spring 56 to once again direct an outward load on the pins 52*a* and 52*b* and thus causing pins 52*a* and 52*b* to be securely engaged in the aligned apertures 24 and 34 at the location desired.

The height of the handle 51 relative to the crutch 10 may also be changed by releasing lever 57 in the manner described above and sliding handle 51 to a different set of apertures 24 and 34 relative to the sections 20 and 30.

Designed to fit over the handle 51 is a contoured handgrip (not shown). In this alternative embodiment the handgrip is also made from a foam rubber material, the same as in the FIG. 3 embodiment.

As shown above, the handle and height adjustment means of FIGS. 3 and 4 each allow for one-step adjustment of both crutch height relative to the floor and handle height relative to the crutch. This is a simpler and faster procedure than for conventional crutch designs which normally employ a two-step system for adjusting crutch height and handle height. Expedited sizing of the crutch benefits the user of the crutch 10 as well as benefiting the therapist or hospital personnel assigned to the task of properly fitting the crutch to a user.

Because the crutch 10 of the present invention does not have the conventional brace bow design, the risk of injury from cut ends of tubing is reduced. Also because there is only one mechanism for both crutch-height and handle-height positioning, the risk of injury from sharp edges of fasteners or connectors is also reduced.

It is understood that the present invention is not limited to the embodiment described above but is defined by the following claims.

I claim:

1. An improved axillary crutch to aid ambulation comprising:

an underarm bend section having a top end, a bottom end and two sides, the sides of the underarm bend section being in parallel relation to one another except at the top end of the underarm bend section; a foot bend section having a top end, a bottom arcuate end and two sides, the sides of the foot bend section being in parallel relation to one another except at the bottom arcuate end of the foot bend section, wherein the bottom arcuate end comes into contact with the floor during ambulation and wherein the arcuate design of the bottom arcuate end of the foot bend section is derived from the natural arcing motion of the crutch during ambulation, wherein the underarm bend section and the foot bend section each comprise a single piece of hollow tubing and the top end of the foot bend section telescopes into the bottom end of the underarm bend section;

a handle located intermediate the top end of the underarm bend section and the bottom arcuate end of the foot bend section; means for inter-connecting and securing the bottom end of the underarm bend section, the top end of the foot bend section and the handle; and an arcuate crutch tip attached to the bottom arcuate end of the foot bend section.

2. The crutch of claim 1 wherein the means for interconnecting comprises a bolt extending through the handle and through aligned apertures in the bottom end of the unerarm bend section and in the top end of the foot bend section, said means for inter-connecting allowing for one-step adjustment of both the height of the crutch relative to the floor and the height of the handle relative to the crutch.

3. The crutch of claim 1 wherein the means for interconnecting comprises:

a handle;

a first shaft located within the handle;

a second shaft located within the handle;

a spring wound around a first end of the first shaft and a first end of the second shaft;

a first retractable pin secured to a second end of the first shaft and a second retractable pin secured to a second end of the second shaft;

a lever attached to either the first end of the first shaft or the first end of the second shaft for exerting a load on the spring when the lever is in a first position thereby extending the first and second retractable pins through aligned apertures in the bottom end of the underarm bend section and in the top end of the foot bend section, said lever also for releasing the load on the spring when in a second position thereby retracting the first and second retractable pins from the aligned apertures.

* * * * *